US005538235A

United States Patent [19]

Bahr et al.

[11] Patent Number: 5,538,235

[45] Date of Patent: Jul. 23, 1996

[54] FEEDING APPARATUS

[75] Inventors: Timothy A. Bahr, Brooklyn Park; Mel J. Bahr, Corcoran, both of Minn.

[73] Assignee: MGS Machine Corporation, Maple Grove, Minn.

[21] Appl. No.: 382,613

[22] Filed: Feb. 2, 1995

[51] Int. Cl.[6] ..... B65H 3/08

[52] U.S. Cl. ..... 271/99; 271/104; 271/107; 271/108; 271/138; 271/144

[58] Field of Search ..... 271/12, 14, 15, 271/10.15, 16.16, 99, 104, 107, 108, 132, 137, 138, 142, 144; 414/797.8, 797.9

[56] References Cited

U.S. PATENT DOCUMENTS

| | | | |
|---|---|---|---|
| 3,105,681 | 10/1963 | Bishop et al. | 271/99 |
| 3,226,108 | 12/1965 | Bishop | 271/99 |
| 3,279,788 | 10/1966 | Shields | 271/99 |
| 3,285,602 | 11/1966 | Hartel | 271/99 |
| 3,588,095 | 6/1971 | Ward et al. | 271/132 |
| 3,874,655 | 4/1975 | Allen et al. | 271/99 |
| 3,904,190 | 9/1975 | Kuehn | 271/99 |
| 3,908,983 | 9/1975 | Long . | |
| 3,973,768 | 8/1976 | Shannon | 271/99 |
| 4,008,889 | 2/1977 | Ayres | 271/99 |
| 4,009,876 | 3/1977 | Smiltneek | 271/108 |
| 4,651,983 | 3/1987 | Long . | |
| 4,903,600 | 2/1990 | Long . | |
| 5,074,432 | 12/1991 | MacNamara | 271/144 |
| 5,129,641 | 7/1992 | Long . | |

*Primary Examiner*—H. Grant Skaggs
*Attorney, Agent, or Firm*—Merchant & Gould

[57] ABSTRACT

An apparatus which uses vacuum to singly feed pieces from a stack. The feeding apparatus has a plate supporting a bottom of the stack and defining a plurality of plate apertures. The plate is connected to a drive mechanism which moves the plate between rearward and forward positions. The plate apertures are in fluid communication with a first vacuum source which provides a vacuum to the plate apertures. When the drive mechanism moves the plate from the rearward to the forward position, the vacuum source provides a vacuum to the plate apertures for holding a bottom-most piece of the stack against the plate. As the bottom-most piece of the stack is moved forward, a metering member prevents other pieces of the stack from being moved along with the bottom-most piece.

10 Claims, 5 Drawing Sheets

FEEDING APPARATUS

FIELD OF THE INVENTION

The present invention relates generally to an apparatus for feeding pieces from a stack. Specifically, the present invention relates to an apparatus which uses vacuum to singly feed bottom-most pieces from a stack into a take-away system.

BACKGROUND OF THE INVENTION

Pieces such as coupons, inserts, pads, cards, leaflets, forms, etc. are most efficiently transported in stacks. Often such pieces must be individually removed from the stack and inserted within or attached to other products. For this reason, devices were developed to rapidly feed pieces singly from a stack.

Existing feed devices support a stack of pieces on a continuously moving belt. The bottom-most piece of the stack contacts the surface of the continuously moving belt. Friction between the continuously moving belt and the bottom-most piece moves the bottom-most piece along with the belt. The bottom-most piece is moved by the belt beneath a friction member which prevents other pieces from the stack from being moved by the belt along with the bottom-most piece. Once the bottom-most piece passes the friction member, it is fed into a take-away system.

When moving certain types of pieces, continuous belts can cause jamming, folding, creasing, marking and other related damage to the pieces. What is needed is an improved feeding apparatus for moving a bottom-most piece from a stack.

SUMMARY OF THE INVENTION

The present invention is a feeding apparatus which uses vacuum to feed pieces from the bottom of a stack into a take away system. The feeding apparatus has a support member such as a plate for supporting a bottom of the stack. The plate has a plurality of apertures and is movable between a first position and a second position. A vacuum assembly is in fluid communication with the apertures and selectively provides a vacuum to the apertures for holding the bottom-most piece of the stack against the plate as it is moved from the first to the second position. In this way, the bottom-most piece is moved from the first position to the second position by the plate. As the bottom-most piece of the stack is moved forward, a metering member prevents other pieces of the stack from being moved along with the bottom-most piece. Once the plate reaches the second position, the piece is fed into the take-away system.

In alternative embodiments, the feeding apparatus may have a tongue extending longitudinally forward from a front end of the plate for supporting a front portion of the bottom-most piece.

In another embodiment, the plate apertures may be selectively in fluid communication with a compressed air source for reducing friction between the bottom-most piece and the plate.

In still another embodiment, the feeding apparatus may include a removable pusher lug adapted for temporary attachment to a backside of the plate for pushing thick pieces from the stack into the take away system.

Accordingly, it is an object of this invention to provide an improved feeding apparatus for feeding pieces from a stack without using a continuous friction belt. It is another object of this invention to provide a feeding apparatus that uses vacuum to move a bottom-most piece from a stack. It is still another object of this invention to provide a feeding apparatus that moves bottom-most pieces from a stack without creasing, folding, marking, or otherwise damaging the bottom-most piece.

BRIEF DESCRIPTION OF THE DRAWINGS

Referring now to the drawings wherein like reference numerals generally indicate corresponding parts throughout the several views.

DETAILED DESCRIPTION OF THE PREFERRED EMBODIMENT

Throughout the following description, reference will be made to the drawings and the same numerals will be used throughout the several views to indicate the same or like parts of the invention.

Figure 1:
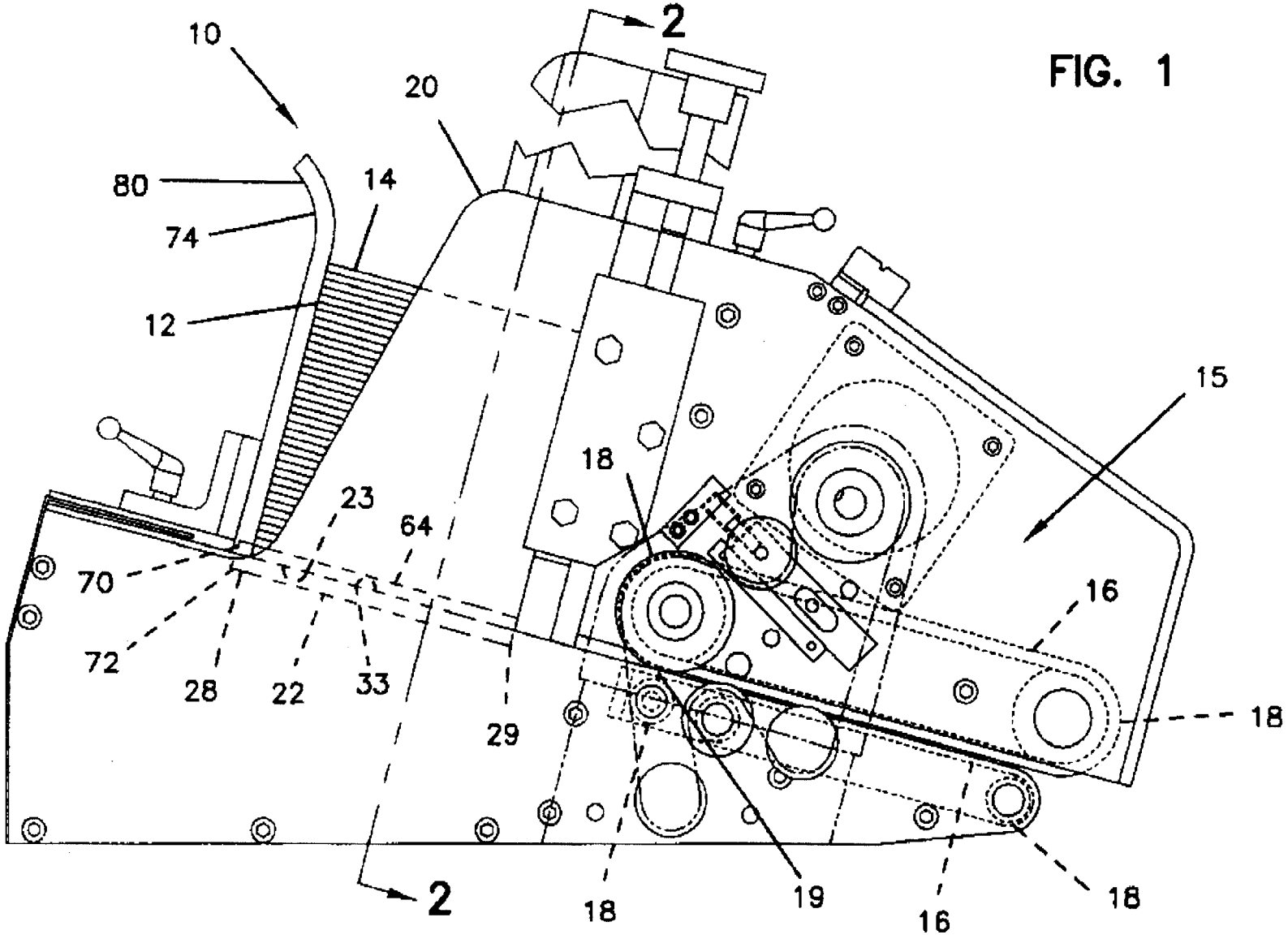
FIG. 1 is a side view of an embodiment of the feeding apparatus of this invention.

Referring now to FIG. 1, there is illustrated an embodiment of a feeding apparatus 10 for feeding pieces 12 from a stack 14 into a take away system such as a conveyor 15 having a plurality of belts 16 mounted on drive rollers 18 and defining conveyor nips 19. It will be appreciated that the take away system could include a wide range of belt and roller configurations that are conventionally known in the art. It will also be appreciated that the pieces 12 fed from the stack 14 could include a wide range of items such as papers, forms, posters, inserts, leaflets, pads, booklets, magazines, coupons, video cassettes, cards, or any other like products that are conventionally stacked and fed into take away systems.

Figure 2:
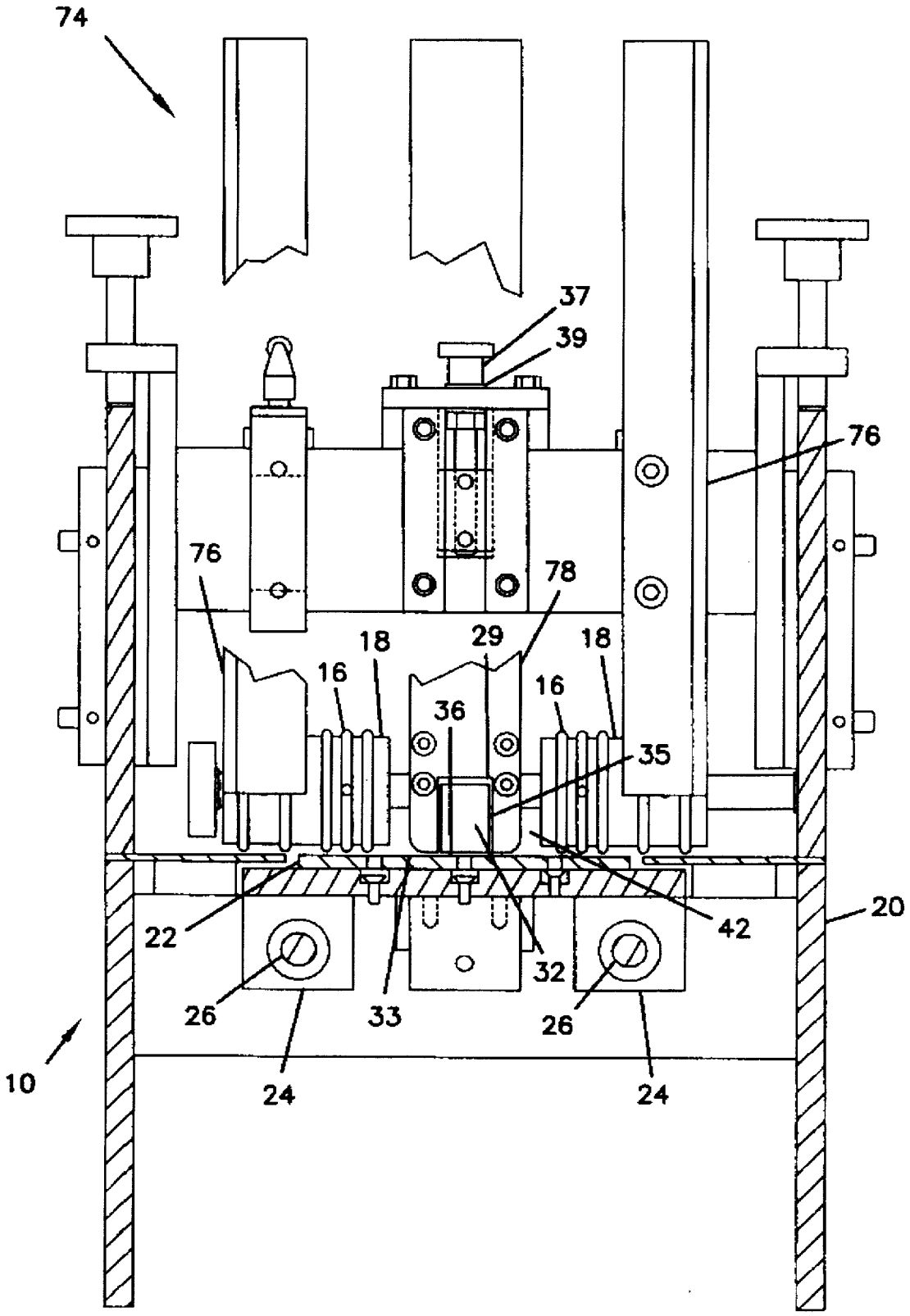
FIG. 2 is a cross-sectional view taken generally along section line 2—2 of the feeding apparatus of FIG. 1.

The feeding apparatus 10 is supported by an outer housing 20 and has a support member such as a plate 22 for supporting a bottom 23 of the stack 14. As shown in FIG. 2, the plate 22 is connected to a set of linear bearings 24. The linear bearings 24 are slidably mounted on a pair of shafts 26 that are each connected to the outer housing 20 of the feeding apparatus 10 by a conventional bracket assembly (not shown). Although the preferred embodiment uses linear bearings 24 to slidingly connect the plate 22 to the outer housing 20, it will be appreciated that any conventional sliding connecting structure is also within the overall concept of this invention.

Figure 3:
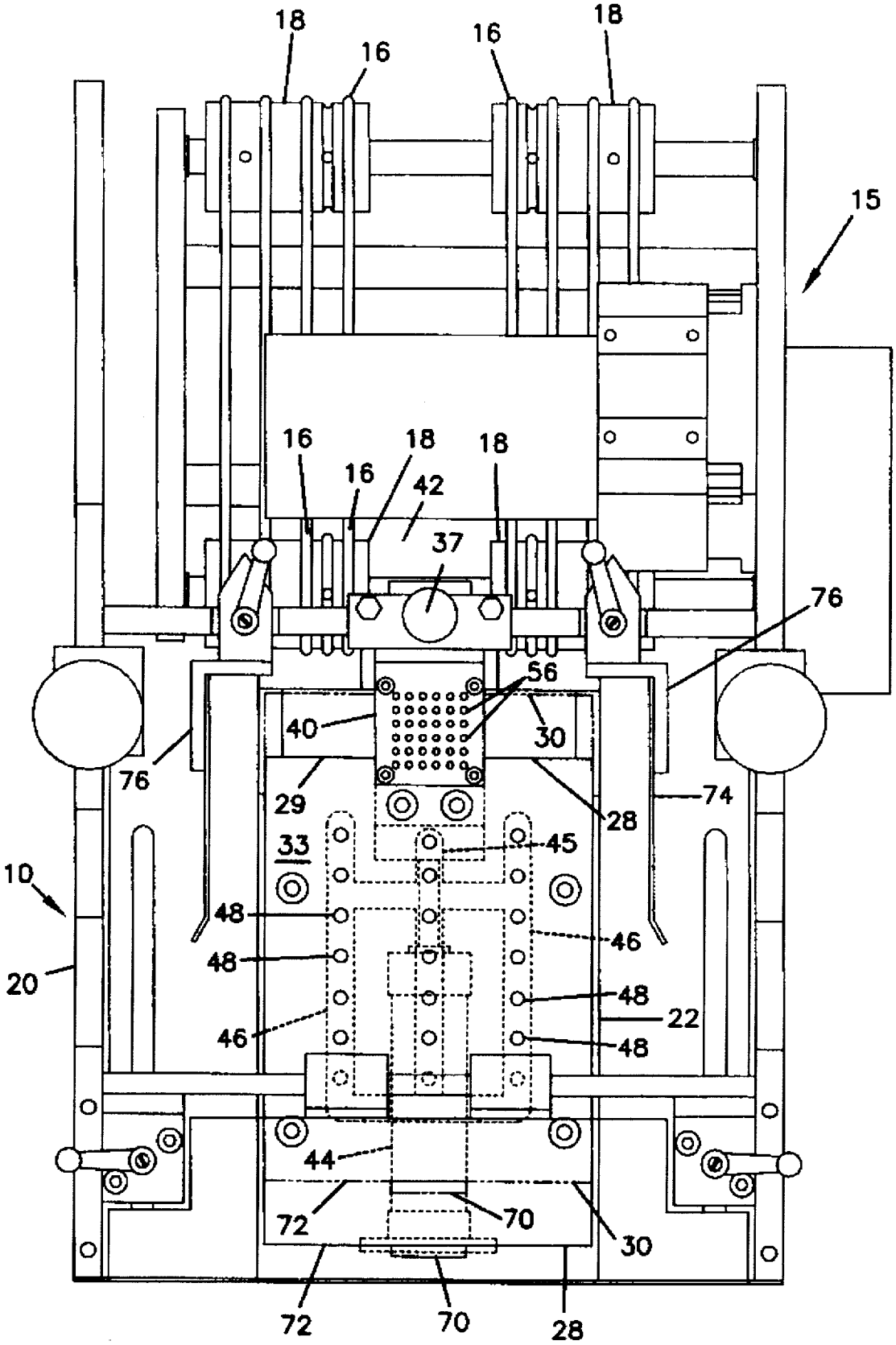
FIG. 3 is a top plan view of the feeding apparatus shown in FIG. 1.

As best shown in FIG. 3, the plate 22 is longitudinally movable between a rearward position 28 (shown in solid lines) and a forward position 30 (shown in phantom lines). In the rearward position 28, a front end 29 of the plate 22 is positioned away from the conveyor 15. In the forward position 30, the front end 29 is positioned adjacent to the conveyor 15.

The feeding apparatus 10 is also equipped with a magazine assembly 74 for supporting the sides of the stack 14. Referring to FIG. 3, the magazine assembly 74 includes a pair of L-shaped adjustable arms 76 for supporting the front and width of the stack 14. Referring to FIG. 2, the magazine assembly 74 also includes a central member 78 for supporting the front of the stack 14. Referring to FIG. 1, the magazine assembly 74 further includes an adjustable rear plate 80 for supporting the back of the stack 14.

Referring to FIG. 2, a metering member such as a roller 32 is connected to the bottom of the central member 78. The roller 32 is positioned within a slot 29 defined by the central member 78 and is mounted on a shaft 35 that is journalled into the sides of the slot 29. The roller 32 defines a nip 36 between an upper surface 33 of the plate 22 and the roller 32 when the plate 22 is in the forward position 30. Although the preferred embodiment of this invention utilizes a roller 32 as a metering member, it will be appreciated that any nip forming member is within the overall concept of this invention. Additionally, it will be appreciated that in this invention the roller 32 is constructed of rubber, plastic or a like material and can be idle, rotatedly driven or restrained from rotating.

Connected to the central member 78 is an adjustment mechanism having an adjustment screw 37 that threadingly engages a bore 39. The adjustment screw 37 is used to control the gap of the nip 36. By rotating the adjustment screw 37 in a first direction, the central member 78 is moved downward causing the roller 32 to be moved closer to the upper surface 33 of the plate 22 thereby narrowing the gap of the nip 36. In contrast, by rotating the adjustment screw 37 is a second direction, the central member 78 is moved upward causing the roller 32 to be moved away from the upper surface 33 of the plate 22 thereby widening the gap of the nip 36.

As best shown in FIG. 3, connected to the front end 29 of the plate 22 is a tongue 40 that extends longitudinally forward towards the conveyor 15. The tongue 40 is longitudinally aligned with the roller 32 and a gap 42 defined by the conveyor rollers 18. When the plate 22 is moved from the rearward position 28 to the forward position 30, the tongue 40 moves directly beneath the roller 32 and fits within the gap 42 defined by the conveyor rollers 18. Although the preferred embodiment of this invention has the tongue 40, it will be appreciated that a feeding apparatus not having a tongue is fully functional and completely within the overall concept of this invention.

Referring again to FIG. 3, a drive mechanism such as a pneumatic cylinder 44 (shown in hidden lines) drives the plate 22 between the rearward position 28 and the forward position 30. The pneumatic cylinder 44 is positioned below the plate 22 and has a moveable shuttle 45 (shown in hidden lines) conventionally connected to the plate 22 between the linear bearings 24. It will be appreciated that other drive mechanisms such as hydraulic cylinders, drive motors or similar devices are within the overall concept of this invention.

Figure 4:
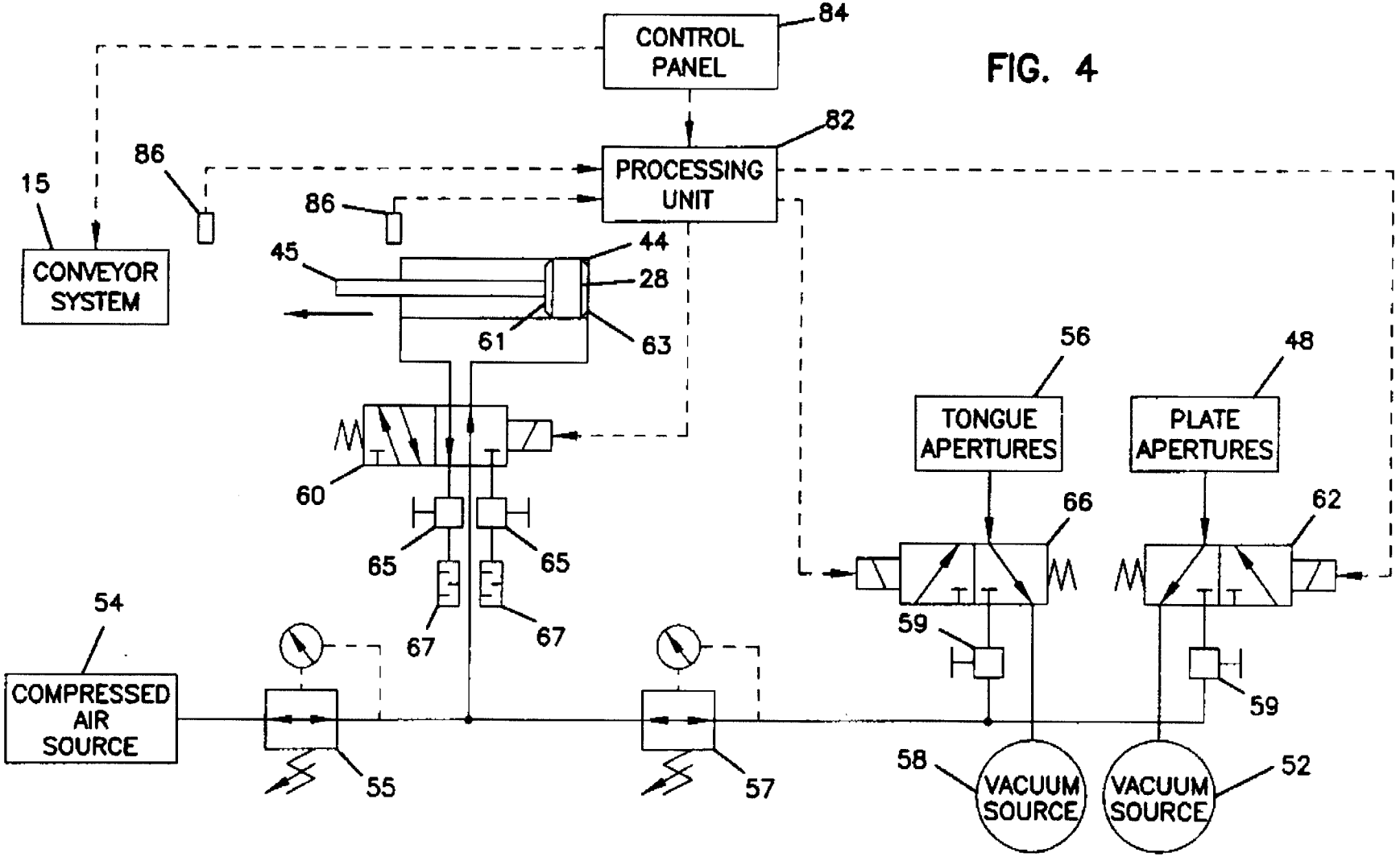
FIG. 4 is a schematic diagram illustrating the valve configuration for the feeding apparatus shown in FIG. 1 as the feeding apparatus moves a piece from a rearward to a forward position.
Figure 5:
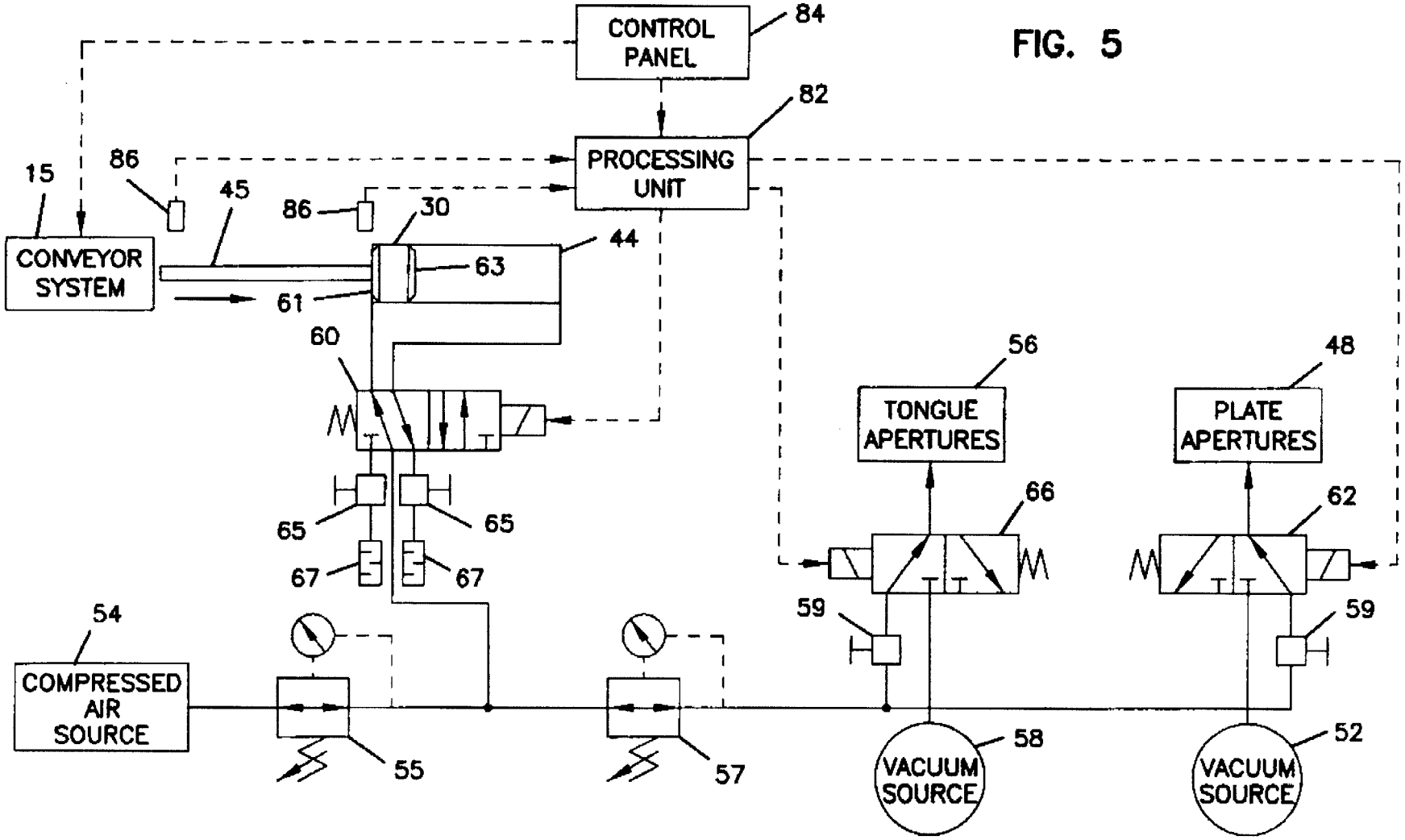
FIG. 5 is a schematic diagram illustrating the valve configuration for the feeding apparatus shown in FIG. 1 as a plate of the feeding apparatus moves from the forward position to the rearward position.

As best shown in FIG. 3, the plate 22 defines a plurality of fluidly interconnected ducts 46 (shown in hidden lines) that are in fluid communication with a plurality of plate apertures 48 defined by the upper surface 33 of the plate 22. The plurality of ducts 46 are selectively in fluid communication with a first vacuum source 52, as shown in FIGS. 4 and 5, which provides a vacuum to the plate apertures 48. It will be appreciated that the first vacuum source 52 could be any conventional vacuum source such as a pump or a venturi. The first vacuum source 52 generally provides a vacuum ranging from 0–20 inches of mercury. However, it will be appreciated that vacuum sources providing a vacuum outside of this range are within the scope of this invention.

Referring again to FIG. 3, the tongue 40 defines a cavity (not shown) that is in fluid communication with a plurality tongue apertures 56. The cavity (not shown) is selectively in fluid communication with a second vacuum source 58 (shown in FIGS. 4 and 5). The second vacuum source 58 provides a vacuum to the tongue apertures 56. It will be appreciated that the second vacuum source 58 could be any conventional vacuum source such as a pump or a venturi. The second vacuum source 58 generally provides a vacuum ranging from 0–20 inches of mercury. However, it will be appreciated that vacuum sources providing a vacuum outside of this range are within the scope of this invention. It will further be appreciated that in alternative embodiments, the first vacuum source 52 could be selectively in fluid communication with the tongue apertures 56 thereby eliminating the need for the second vacuum source 58.

The plurality of ducts 46 and the tongue cavity (not shown) are also selectively in fluid communication with a compressed air source 54, as shown in FIGS. 4 and 5, for forcing air out of the plate apertures 48 and tongue apertures 56. It will be appreciated that the compressed air source 54 could be a tank of compressed air, a pump or any other device for supplying compressed air that is conventionally known in the art. This compressed air source 54 also provides air pressure to the pneumatic cylinder 44 for driving the shuttle 45 which moves the plate 22 between the rearward position 28 and the forward position 30.

The compressed air source 54 generally provides air pressure ranging from 60 to 80 psi. Positioned downstream from the compressed air source 54 is a first conventional air pressure regulator 55 for regulating the air pressure from the compressed air source 54. A second conventional air pressure regulator 57 regulates the air pressure directed towards the plate apertures 48 and the tongue apertures 56. The second air pressure regulator 57 generally allows an air pressure ranging from 0–15 psi to reach the plate apertures 48 and the tongue apertures 56. A first pair of conventional needle valves 59 further control the flow of air to the plate apertures 48 and the tongue apertures 56.

Referring to FIGS. 4 and 5, a cylinder valve mechanism 60 such as a solenoid activated three-way valve switches the flow of air from the compressed air source 54 between a front side 61 and a back side 63 of the pneumatic cylinder shuttle 45. As shown in FIG. 4, when fluid communication between the compressed air source 54 and the back side 63 of the shuttle 45 is open, compressed air forces the shuttle 45 forward thereby causing the shuttle 45 to drive the plate 22 from the rearward position 28 to the forward position 30. In contrast, as shown in FIG. 5, when fluid communication between the compressed air source 54 and the front side 61 of the shuttle 45 is open, compressed air from the compressed air source 54 forces the shuttle 45 rearward thereby causing the shuttle 45 to drive the plate 22 from the forward position 30 to the rearward position 28.

Positioned along the outlet lines of the cylinder valve mechanism 60 is a second pair of conventional needle valves 65 for controlling the speed of the shuttle 45. Positioned downstream from the second pair of conventional needle valves 65 is a pair of conventional mufflers 67 for reducing noise generated by the pressurized air as it exits the cylinder 44.

Referring again to FIGS. 4 and 5, fluid communication between the first vacuum source 52 and the plate apertures 48 is controlled by a first valve mechanism 62 such as a conventional solenoid actuated three-way valve. The first valve mechanism 62 opens fluid communication between the plate apertures 48 and the first vacuum source 52 when the plate 22 is moved from the rearward position 28 to the forward position 30 as shown in FIG. 4. The open fluid communication between the plate apertures 48 and the first vacuum source 52 provides a vacuum to the plate apertures 48 that causes a bottom-most piece 64 (shown in FIG. 1) from the stack 14 to be held against the upper surface 33 of the plate 22 as the plate 22 is moved from the rearward position 28 to the forward position 30. The first valve mechanism 62 closes fluid communication between the first vacuum source 52 and the plate apertures 48 when the plate is moved from the forward position 30 to the rearward position 28 as shown in FIG. 5.

In a similar manner, the first valve mechanism 62 also controls fluid communication between the compressed air source 54 and the plate apertures 48. The first valve mechanism 62 opens fluid communication between the compressed air source 54 and the plate apertures 48 when the plate 22 is moved from the forward position 30 to the rearward position 28 as shown in FIG. 5. The open communication between the compressed air source 54 and the plate apertures 48 causes air to be forced out of the plate apertures 48. The forced air reduces friction between the bottom-most piece 64 of the stack 14 and the upper surface 33 of the plate 22 when the plate 22 is moved from the forward position 30 to the rearward position 28. This allows the plate 22 to be moved from the forward position 30 to the rearward position 28 without creasing, wrinkling or damaging the bottom-most piece 64 of the stack 14. The first valve mechanism 62 closes fluid communication between the compressed air source 54 and the plate apertures 48 when the plate 22 is moved from the rearward position 28 to the forward position 30 as shown in FIG. 4.

Referring again to FIGS. 4 and 5, a second valve mechanism 66 such as a conventional solenoid actuated three-way valve controls fluid communication between the second vacuum source 58 and the tongue apertures 56. The second valve mechanism 66 opens fluid communication between the tongue apertures 56 and the second vacuum source 58 when the plate 22 is moved from the rearward position 28 to the forward position 30 as shown in FIG. 4. The open fluid communication between the tongue apertures 56 and the second vacuum source 58 provides a vacuum to the tongue apertures 56 for holding a front portion of the bottom-most piece 64 of the stack 14 against the tongue 40 when the plate 22 is moved from the rearward position 28 to the forward position 30. The second valve mechanism 66 closes fluid communication between the second vacuum source 58 and the tongue apertures 56 when the plate 22 is moved from the forward position 30 to the rearward position 28 as shown in FIG. 5.

Similarly, the second valve mechanism 66 also controls fluid communication between the compressed air source 54 and the tongue apertures 56. The second valve mechanism 66 opens fluid communication between the compressed air source 54 and the tongue apertures 56 when the plate 22 is moved from the forward position 30 to the rearward position 28 as shown in FIG. 5. The open fluid communication between the compressed air source 54 and the tongue apertures 56 causes air to be forced out of the tongue apertures 56. The forced air from the tongue apertures 56 reduces friction between the tongue 40 and the bottom-most piece 64 of the stack 14. This allows the plate 22 to be moved from the forward position 30 to the rearward position 28 without damaging the bottom-most piece 64 of the stack 14. The second valve mechanism 66 closes fluid communication between the compressed air source 54 and the tongue apertures 56 when the plate 22 is moved from the rearward position 28 to the forward position 30 as shown in FIG. 4.

It will be appreciated that in alternative embodiments of this invention, the tongue apertures 56 could be in fluid communication with the first vacuum source 52. This particular configuration would eliminate the need for the second vacuum source 58 and the second valve mechanism 66. Instead, the first vacuum source 52 would provide a vacuum to the tongue apertures 56 and the first valve mechanism 62 would selectively control fluid communication between the tongue apertures 56 and the first vacuum source 52.

As shown in FIGS. 1 and 3, the feeding apparatus 10 can also be equipped with a removable pusher lug 70 which can be temporarily connected to a back end 72 of the plate 22. When the plate 22 is in the rearward position 28, the pusher lug 70 fits within a slot (not shown) in the adjustable rear plate 80 of the magazine assembly 74. The pusher lug 70 is used to push thick bottom-most pieces 64 such as cassettes, books or magazines along with the plate from the rearward position 28 to the forward position 30. In this way, thick bottom-most pieces are fed from the stack 14 into the conveyor 15.

The pusher lug 70 generally has a height equal to the thickness of the pieces 14 being fed into the conveyor 15. When the pusher lug 70 is connected to the back end 72 of the plate 22, the first vacuum source 52, the second vacuum source 58 and the compressed air source 54 are generally not in fluid communication with either the tongue apertures 56 or the plate apertures 48. However, there may be situations in which both the vacuum sources 52, 58 and the pusher lug 70 are used simultaneously.

As shown in FIGS. 4 and 5, the feeding apparatus 10 is electronically controlled by a conventional central processing unit 82. The central processing unit 82 has a control panel 84 such as a keyboard or miscellaneous control buttons for allowing operator input. The central processing unit 82 monitors the position of the plate 22 by receiving and processing signals generated by a pair of shuttle sensors 86 such as conventional electronic photocells or contact switches which are located adjacent to the rearward position 28 and the forward position 30 of the plate 22. The central processing unit 82 is electronically connected to the pneumatic cylinder valve mechanism 60, the first valve mechanism 62 and the second valve mechanism 66 for controlling the operation of the feeding apparatus 10.

In operation, the feeding apparatus 10 begins with the plate 22 positioned in the rearward position 28. The stack 14 of pieces 12 is supported by the upper surface 33 of the plate 22. The front portion of the bottom-most piece 64 of the stack 14 extends forward past the front end 29 of the plate 22.

When the feeding apparatus 10 is turned on by the control panel 84, the central processing unit 82 signals the pneumatic cylinder valve mechanism 60 to open fluid communication between the compressed air source 54 and the back side 63 of the pneumatic cylinder shuttle 45 thereby driving the plate 22 from the rearward position 28 towards the forward position 30.

Simultaneously, the central processing unit 82 signals the first valve mechanism 62 to open fluid communication between the first vacuum source 52 and the plate apertures 48. The fluid communication between the first vacuum source 52 and the plate apertures 48 provides a vacuum at the plate apertures 48 that holds the bottom-most piece 64 of the stack 14 against the upper surface 33 of the plate 22.

Also simultaneously, the central processing unit 82 signals the second valve mechanism 66 to open fluid communication between the tongue apertures 56 and the second vacuum source 58. The fluid communication between the tongue apertures 56 and the second vacuum source 58 provides a vacuum at the tongue apertures 56 that holds the front portion of the bottom-most piece 64 against the tongue 40. Through the vacuum provided by the tongue apertures 56 and the plate apertures 48, the bottom-most piece 64 of the stack 14 is held firmly against the plate upper surface 33 and the tongue 40 as the plate 22 is moved from the rearward position 28 to the forward position 30.

As the plate 22 carrying the bottom-most piece 64 moves from the rearward position 28 to the forward position 30, the tongue 40 and upper plate surface 33 move beneath the roller 32 thereby forming the nip 36 located between the roller 32 and the plate 22. The clearance of the nip 36 is such that only the bottom-most piece 64 of the stack is allowed to pass through the nip 36 as the plate 22 moves from the rearward position 28 to the forward position 30. The remainder of the pieces 12 on the stack 14 are held back by the roller 32.

When the plate 22 reaches the forward position 30, the front portion of the bottom-most piece 64 is inserted into the conveyor nip 19 of the take away conveyor 15. In this way, the bottom-most piece 64 is fed into the take away conveyor 15 which transports the bottom-most piece 64 away from the feeding apparatus 10. When the bottom-most piece 64 is moved away from the feeding apparatus 10, it is replaced by a subsequent bottom-most piece 64 which contacts the upper surface 33 of the plate 22.

Also when the plate 22 reaches the forward position 30, the pneumatic cylinder shuttle 45 triggers one of the shuttle sensors 86 which sends a signal to the central processing unit 82. The central processing unit 82 then sends signals to the first valve mechanism 62, the second valve mechanism 66 and the cylinder valve mechanism 60. Upon receiving the signal from the central processing unit 82, the cylinder valve mechanism 60 opens communication between the compressed air source 54 and the front side 61 of the shuttle 45 thereby causing the shuttle 45 to drive the plate 22 from the forward position 30 to the rearward position 28.

Simultaneously, upon receiving the signal from the central processing unit 82, the valve mechanisms 62, 66 open fluid communication between the compressed air source 54 and the tongue apertures 56 and plate apertures 48. In this way, air is forced through the tongue apertures 56 and plate apertures 48 to reduce friction between the subsequent bottom-most piece 64 of the stack 14 and the upper surface 33 of the plate 22 and the tongue 40 as the plate 22 is moved from the forward position 30 to the rearward position 28. Once the plate 22 reaches the rearward position 28, one of the shuttle sensors 86 is triggered and the cycle described above is repeated.

It is to be understood that even though numerous characteristics and advantages of the invention have been set forth in the forgoing description, together with details of the structure and function of the invention, the disclosure is illustrative only, and changes may be made in detail, especially in matters of shape, size and arrangement of the parts within the principles of the invention to the full extent indicated by the broad general meaning of the terms in which the appended claims are expressed.

What is claimed is as follows:

1. A feeding apparatus for feeding pieces from a stack into a take-away system, the feeding apparatus comprising:

a) a plate for supporting a bottom of the stack, the plate defining a plurality of plate apertures and being longitudinally moveable between rearward and forward positions;

b) a metering member positioned adjacent a front side of the stack, the metering member defining a nip between the plate and the metering member when the plate is in the forward position, whereby a bottom-most piece of the stack is moved through the nip and fed into the take-away system when the plate is moved to the forward position;

c) a drive mechanism connected to the plate for moving the plate between the rearward and forward positions;

d) a first vacuum source which provides a vacuum to the plate apertures, thereby holding the bottom-most piece of the stack against the plate;

e) a first valve mechanism for selectively opening and closing fluid communication between the plate apertures and the first vacuum source, the first valve mechanism opening fluid communication between the first vacuum source and the plate apertures when the plate is moved from the rearward position to the forward position and closing fluid communication between the first vacuum source and the plate apertures when the plate is moved from the forward position to the rearward position;

f) a tongue extending longitudinally forward from a front end of the plate, the tongue defining a plurality of tongue apertures and being positioned to move beneath the metering member as the plate is moved from the rearward position to the forward position;

g) a second vacuum source for providing a vacuum to the tongue apertures for holding a front portion of the bottom-most piece of the stack against the tongue when the plate is moved from the rearward position to the forward position; and h) a second valve mechanism for selectively opening and closing fluid communication between the tongue apertures and the second vacuum source, the second valve mechanism opening fluid communication between the second vacuum source and the tongue apertures when the plate is moved from the rearward position to the forward position and closing fluid communication between the second vacuum source and the tongue apertures when the plate is moved from the forward position to the rearward position.

2. The feeding apparatus of claim 1, further including a compressed air source for forcing air out of the plate apertures to reduce friction between the bottom-most piece of the stack and the plate, wherein the first valve mechanism selectively opens and closes fluid communication between the compressed air source and the plate apertures, the first valve mechanism closing fluid communication between the compressed air source and the plate apertures when the plate is moved from the rearward position to the forward position, and the first valve mechanism opening fluid communication between the compressed air source and the plate apertures when the plate is moved from the forward position to the rearward position.

3. The feeding apparatus of claim 2, wherein the drive mechanism includes a pneumatic cylinder connected to the compressed air source.

4. The feeding apparatus of claim 1, wherein the metering member is vertically adjustable to control a nip gap.

5. The feeding apparatus of claim 1, wherein the metering member is an idle roller.

6. The feeding apparatus of claim 1, wherein the metering member is a rotatedly driven roller.

7. The feeding apparatus of claim 1, further including a magazine assembly for supporting a length and width of the stack, the magazine assembly being adjustable to provide support for stacks having variable widths and lengths.

8. The feeding apparatus of claim 1, further including a removable pusher lug adapted for attachment to a back side of the plate for pushing thick pieces from the stack into the take-away system.

9. A feeding apparatus for feeding pieces from a stack into a take-away system, the feeding apparatus comprising:

a) a plate for supporting a bottom of the stack, the plate defining a plurality of plate apertures and being longitudinally moveable between rearward and forward positions;

b) a metering member positioned adjacent a front side of the stack, the metering member defining a nip between the plate and the metering member when the plate is in the forward position, whereby a bottom-most piece of the stack is moved through the nip and fed into the take-away system when the plate is moved to the forward position;

c) a drive mechanism connected to the plate for moving the plate between the rearward and forward positions;

d) a first vacuum source which provides a vacuum to the plate apertures, thereby holding the bottom-most piece of the stack against the plate;

e) a source of compressed air selectively in fluid communication with the plate apertures, the source of compressed air being separate from the first vacuum source and being provided to force compressed air through the plate apertures such that friction between the bottom-most piece of the stack and the plate is reduced;

f) a first valve mechanism for alternating fluid communication to the plate apertures between the first vacuum source and the source of compressed air, the first valve mechanism opening fluid communication between the first vacuum source and the plate apertures when the plate is moved from the rearward position to the forward position and opening fluid communication between the source of compressed air and the plate apertures when the plate is moved from the forward position to the rearward position; and (g) a pressure regulator for controlling the amount of compressed air supplied to the plate apertures by the source of compressed air.

10. The feeding apparatus of claim 9, wherein the drive mechanism includes a pneumatic cylinder driven by the compressed air source.

* * * * *